US008622566B2

(12) United States Patent
Martinez

(10) Patent No.: US 8,622,566 B2
(45) Date of Patent: Jan. 7, 2014

(54) LIGHTED GLOVE

(76) Inventor: Michael Martinez, Dallas, TX (US)

( * ) Notice: Subject to any disclaimer, the term of this patent is extended or adjusted under 35 U.S.C. 154(b) by 208 days.

(21) Appl. No.: 13/281,644

(22) Filed: Oct. 26, 2011

(65) Prior Publication Data

US 2012/0140452 A1 Jun. 7, 2012

Related U.S. Application Data

(60) Provisional application No. 61/418,441, filed on Dec. 1, 2010.

(51) Int. Cl.
*F21V 21/08* (2006.01)

(52) U.S. Cl.
USPC ..... 362/103

(58) Field of Classification Search
USPC ..... 362/103
See application file for complete search history.

(56) References Cited

U.S. PATENT DOCUMENTS

| | | | |
|---|---|---|---|
| 3,638,011 | A | 1/1972 | Bain et al. |
| 5,177,467 | A | 1/1993 | Chung-Piao |
| 5,580,154 | A | 12/1996 | Coulter et al. |
| 5,816,676 | A | 10/1998 | Koenen Myers et al. |
| 6,006,357 | A | 12/1999 | Mead |
| 6,592,235 | B1 | 7/2003 | Mayo |
| 6,709,142 | B2 | 3/2004 | Gyori |
| 6,892,397 | B2 | 5/2005 | Raz et al. |
| 2004/0255361 | A1 | 12/2004 | Senter et al. |

*Primary Examiner* — Jason Moon Han
(74) *Attorney, Agent, or Firm* — Dale J. Ream

(57) ABSTRACT

A lighted glove includes a glove member configured to substantially cover a wearer's hand and having finger and thumb sections. A plurality of light modules is positioned in a spaced apart arrangement on a palm section and on interior surface of the finger and thumb sections. Each light module includes multiple LED's having different colors. The light modules are electrically connected to a battery. Different color LED's may be selected using a toggle switch.

11 Claims, 6 Drawing Sheets

LIGHTED GLOVE

CROSS REFERENCE TO RELATED APPLICATION

This non-provisional patent application claims the benefit of provisional application Ser. No. 61/418,441 filed on Dec. 1, 2010, titled Lighted Glove.

BACKGROUND OF THE INVENTION

This invention relates generally to lighted gloves and, more particularly, to a glove having lights integrated therein that may be worn by police, airline personnel, stadium parking and traffic control staff, or others that need to direct traffic flow in dim light conditions.

Law enforcement officers or other traffic control staff frequently direct traffic around a traffic accident scene, emergency detours, into or out of special event parking arrangements, direction of airplanes near airport terminals and taxiways, or other environments where traditional stop signs or stop lights are not feasible or do not provide adequate control in a heavy traffic situation. In low light situations, such as at dusk or after sunset, traffic control personnel may hold a flashlight or a lighted wand so that drivers can more easily see and discern when to go, stop, or what direction they are being encouraged to follow.

Although flashlights and lighted wands may be generally effective for their intended purposes, it is inconvenient and possibly tiring to the traffic control officer to grasp the flashlight for long periods of time. The existing devices present only a single color and may, as a result, not provide an immediate indication to a driver as to the action intended by the officer.

Therefore, it would be desirable to have a glove wearable by a traffic control officer that includes multiple light modules positioned on the palm and finger sections so as to provide an easily viewable light source to drivers and eliminate the need for holding a traditional flashlight. Further, it would be desirable to have a glove that may be toggled between lights having different colors so as to immediately indicate a desired action to a driver. In addition, it would be desirable to have a lighted glove that substantially covers an entire hand of the traffic control officer for stability, protection, and effectiveness.

SUMMARY OF THE INVENTION

A lighted glove according to a preferred embodiment of the present invention includes a glove member configured to substantially cover an entirety of a wearer's hand and having finger and thumb sections. A plurality of light modules is positioned in a spaced apart arrangement on a palm section and on interior surface of the finger and thumb sections. Each light module preferably includes multiple LED's having different colors. The light modules are electrically connected to a battery. Different color LED's may be selected using a toggle switch.

Therefore, a general object of this invention is to provide a lighted glove having multiple light emitting diodes for use in directing vehicle traffic in low ambient light conditions.

Another object of this invention is to provide a lighted glove, as aforesaid, in which each lighting module may include LED's of multiple colors that may be selectively toggled by a user.

Still another object of this invention is to provide a lighted glove, as aforesaid, on which the light modules are positioned on the palm and fingers such that the glove may be used in the manner of a stop sign or stop light, as directed by the user.

Yet another object of this invention is to provide a lighted glove, as aforesaid, that substantially covers a user's entire hand and fingers so as to keep the position of the lights stable for effective traffic control.

A further object of this invention is to provide a lighted glove, as aforesaid, that is easy to use and cost-effective to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
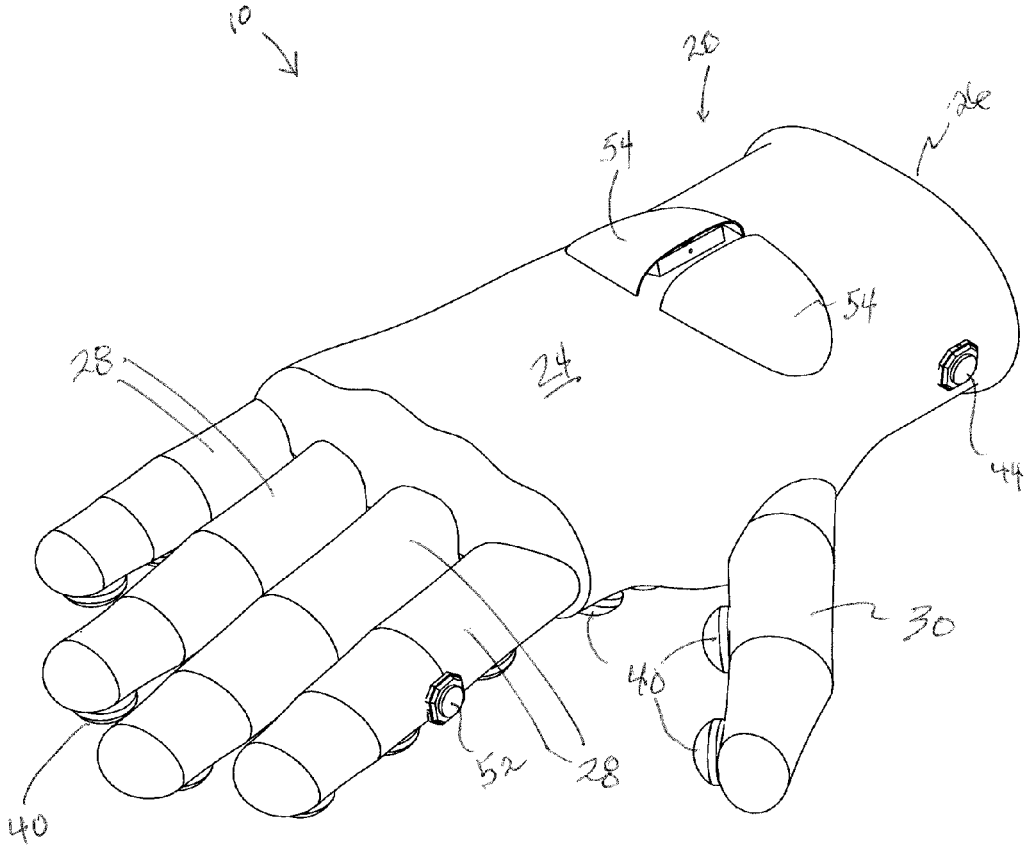
FIG. 1 is a perspective view of a lighted glove according to a preferred embodiment of the present invention.

A lighted glove according to a preferred embodiment of the present invention will now be described in detail with reference to FIGS. 1 to 6 of the accompanying drawings. The lighted glove 10 includes a glove member 20, a plurality of light modules 40, a toggle switch 52, and an activation button 44.

The glove member 20 includes a palm section 22 integrally connected to a back section 24 so as to define an open end 26. Finger sections 28 including a thumb section 30 extend from the palm section 22 and back section 24 in a traditional construction so that the glove member 20 may be worn on a user's hand. Preferably, the glove member 20 provides substantially full coverage of a user's hands and fingers for protection from weather elements or other harsh conditions. The full coverage design also maintains the light modules 40 (described below) in preferred positions. The glove member 20 may be constructed of a durable but flexible material such as a spandex material that is characterized by its stretchy elastic characteristics.

Figure 4:
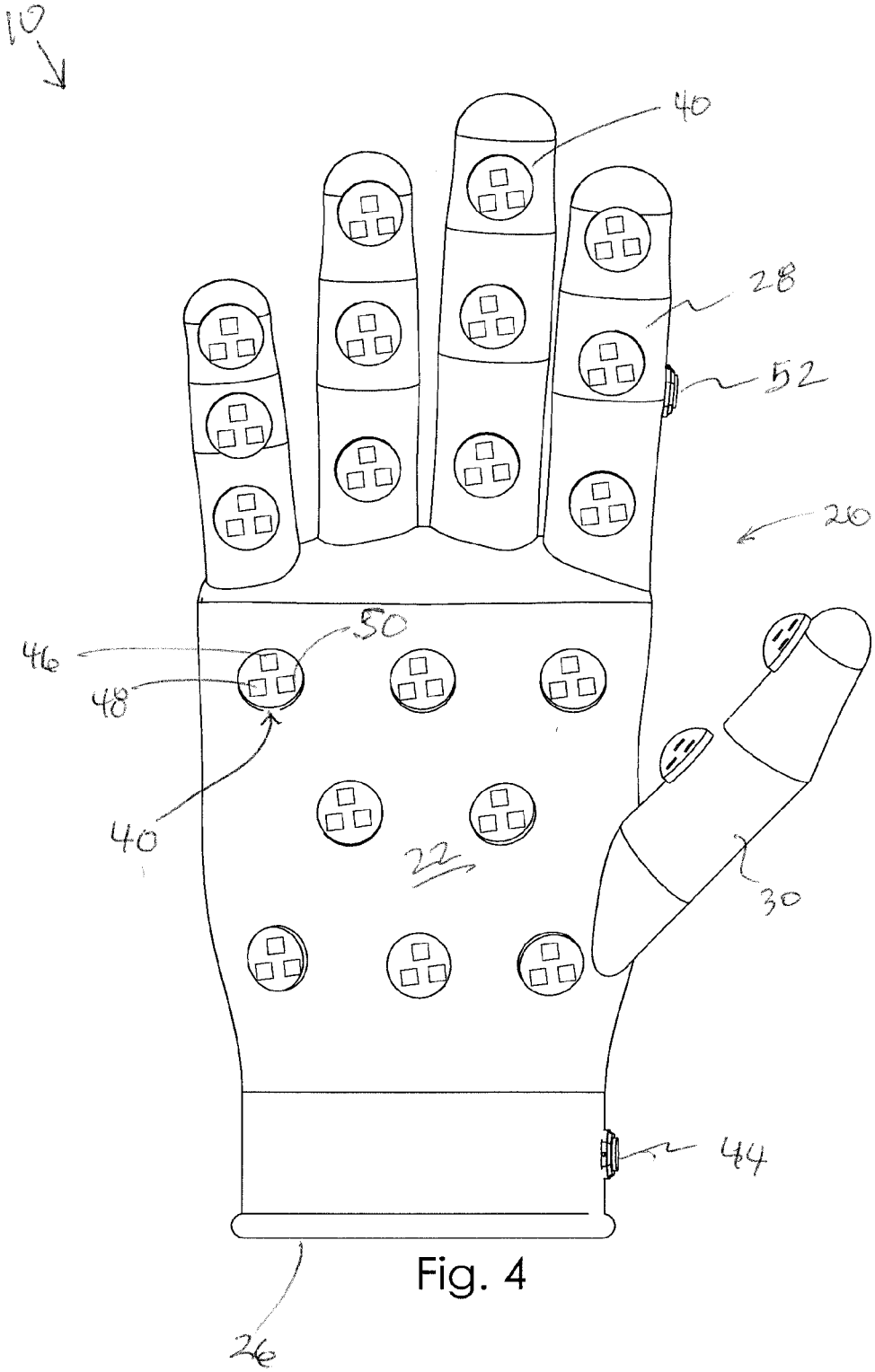
FIG. 4 is a bottom view of the lighted glove as in FIG. 1.

A plurality of light modules 40 are mounted on the palm section 22 and interior surfaces of the finger sections 28 and thumb section 30 (FIG. 4). The light modules 40 are spaced apart from one another. Preferably, each of the light modules 40 includes three light emitting diodes (LED's) although more or fewer LED's would also work. Each of the LED's in a light module 40 presents a different color when activated with current. The light modules 40 are electrically connected to a battery 42 and selectively activated with an on/off button 44. The on/off button 44 may be positioned adjacent the open end 26 for convenience in use although other positions may also be suitable. Each light module 40 may include red 46, yellow 48, and green 50 LED's so as to correspond to respective colors used in stoplights. Further, a toggle switch 52 may be positioned on the glove member 20 and electrically connected to the light modules 40 such that a user may select which color LED should be illuminated when electrically actuated.

The glove member 20 includes one or more pockets 54 configured to contain the battery 42 and other electronic circuitry 56 (FIG. 1). It is understood that the light modules 40, battery 42, and control circuitry 56 may be connected by wires (not shown).

In use, a user such as a law enforcement officer or parking staff may insert his hand through the open end 26 of the glove member 20 and into the finger sections 28 and thumb section 30. In low ambient lighting conditions, the on/off button 44 may be actuated such that electrical current is allowed to flow from the battery 42 to the plurality of light modules 40 causing the LED's to be illuminated. Depending on a particular driving action or direction the user desires to communicate to drivers of vehicles, the user may manipulate the toggle switch 52 to cause particular LED's to be illuminated. For example, the user may communicate the directive "stop" by setting the toggle switch 52 to the red LED 46 and then hold his gloved hand up in a manner that is indicative of a stop sign or stop light. Conversely, the green LED 50 may be activated such that the glove member 20 may indicate a "go" command. Similarly, the yellow LED 48 may be used to urge drivers to drive slowly.

Accordingly, the lighted glove 10 may be used to direct traffic more effectively than in the past and in a manner that is more convenient and less tiresome to the traffic officer.

The invention claimed is:

1. A lighted glove for use by a traffic control worker, comprising:

a glove member having a palm section connected to a back section so as to define an open end, said glove member including a plurality of finger sections and a thumb section extending upwardly from said palm and back sections such that said glove member is wearable on the traffic control worker's hand;

a plurality of light modules mounted to said palm section of said glove member, each light module being spaced apart from any other light module;

wherein each light module includes at least two light emitting diodes (LED's) having different colors;

a power supply in electrical communication with said plurality of light modules;

wherein said glove member includes a pocket situated on said back section and configured to contain said power supply;

a switch situated on said glove member and electrically connected to said plurality of light modules, said switch configured to select which LED of each light module is energized.

2. The lighted glove as in claim 1, wherein each light module includes three LED's, each LED in a respective light module having a color different than each other LED in said respective light module.

3. The lighted glove as in claim 1, wherein said plurality of light modules is mounted to said finger sections and said thumb section.

4. The lighted glove as in claim 3, wherein said plurality of light modules are not mounted to said back section of said glove member.

5. The lighted glove as in claim 1, wherein said switch is configured to select all LED's of a same color when said plurality of light modules is energized.

6. The lighted glove as in claim 1, wherein said power supply is a battery.

7. The lighted glove as in claim 1, wherein said glove member covers substantially an entire hand of the traffic control worker.

8. The lighted glove as in claim 1, further comprising an on/off button configured to regulate transfer of current from said power source to said plurality of light modules.

9. The lighted glove as in claim 1, wherein:

each light module includes three LED's, each LED in a respective light module having a color different than each other LED in said respective light module; and said plurality of light modules are mounted to said finger sections and said thumb section.

10. The lighted glove as in claim 9, wherein said switch is configured to select all LED's of a same color when said plurality of light modules is energized.

11. The lighted glove as in claim 9, wherein said glove member is constructed of a resilient material such that said glove member fits snugly on the traffic control worker's hand.

* * * * *

UNITED STATES PATENT AND TRADEMARK OFFICE

CERTIFICATE OF CORRECTION

Figure 2:
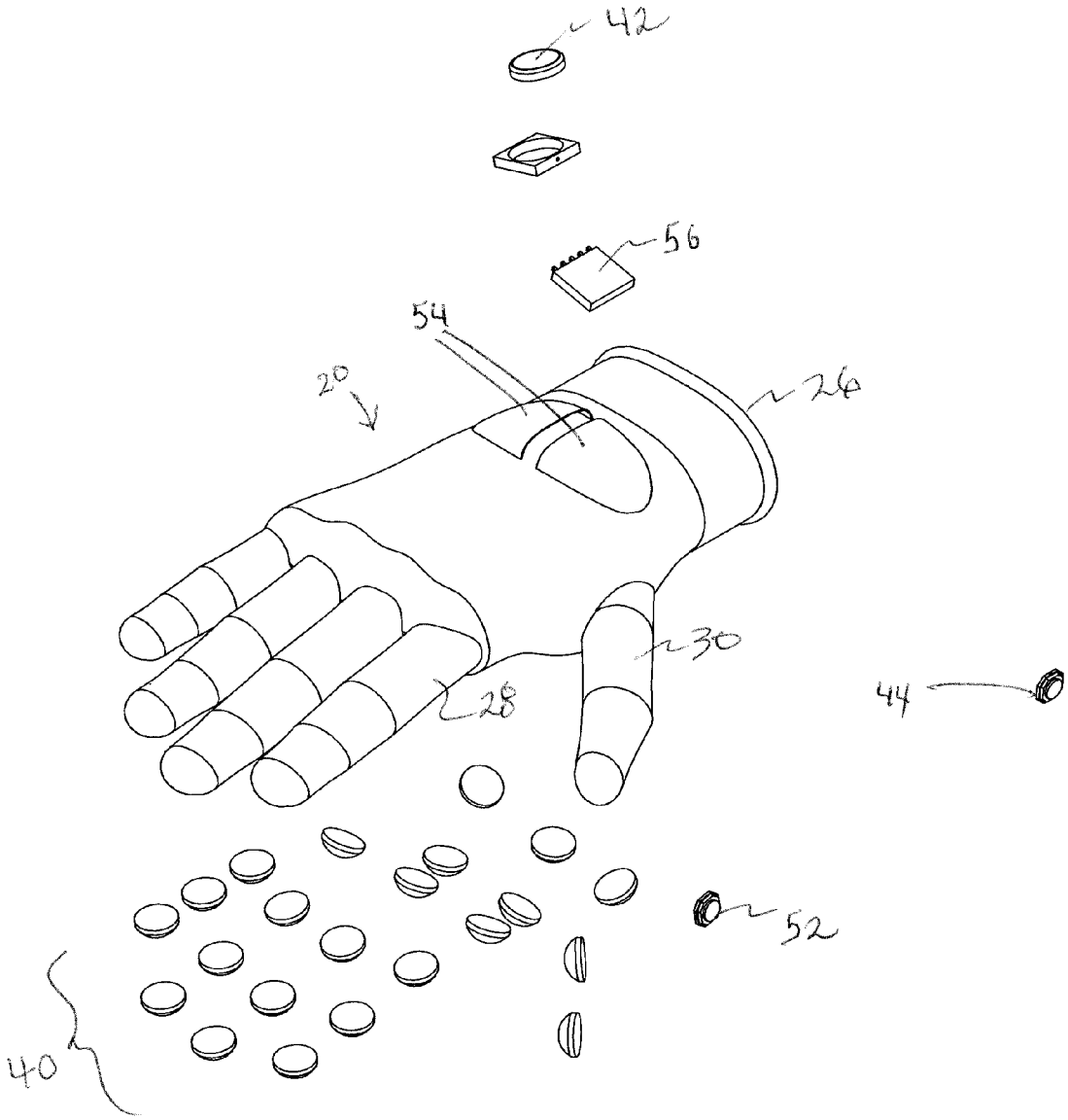
FIG. 2 is an exploded view of the lighted glove as in FIG. 1.

PATENT NO. : 8,622,566 B2
APPLICATION NO. : 13/281644
DATED : January 7, 2014
INVENTOR(S) : Michael Martinez It is certified that error appears in the above-identified patent and that said Letters Patent is hereby corrected as shown below:

On the title page, replace the informal drawing with the formal drawing of Fig 2.

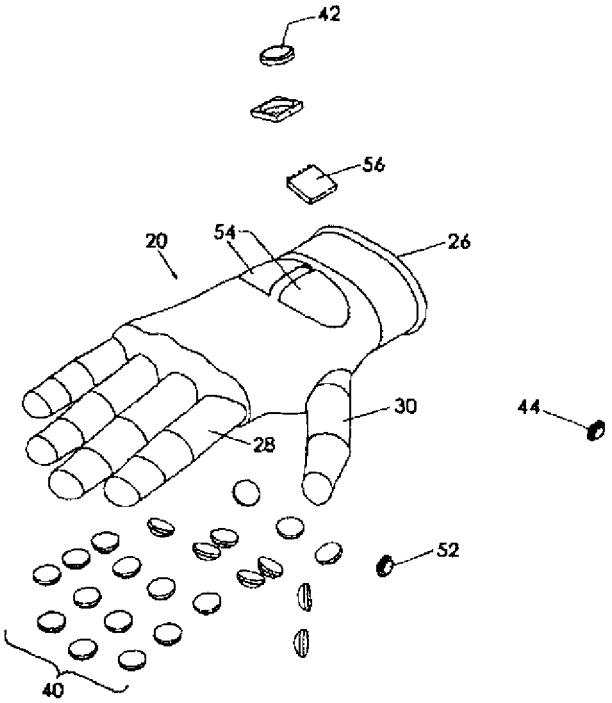

In the Drawings

Signed and Sealed this
Twenty-third Day of September, 2014

Michelle K. Lee

Michelle K. Lee
*Deputy Director of the United States Patent and Trademark Office*

On drawing Sheet 1 of 6, replace the informal drawing of Fig. 1 with formal drawing of Fig. 1.

On drawing Sheet 2 of 6, replace the informal drawing of Fig. 2 with formal drawing of Fig. 2.

Figure 3:
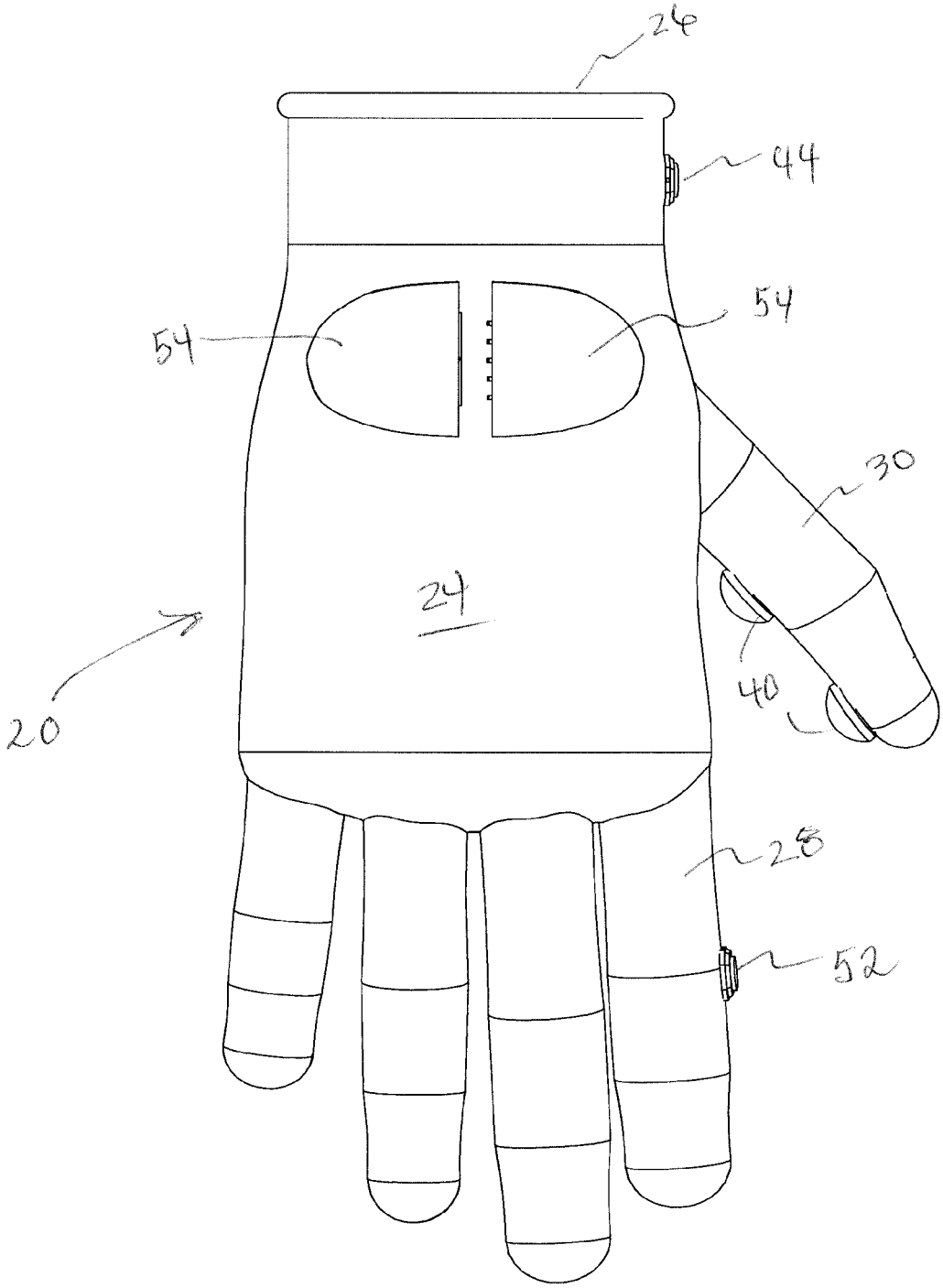
FIG. 3 is a top view of the lighted glove as in FIG. 1.

On drawing Sheet 3 of 6, replace the informal drawing of Fig. 3 with formal drawing of Fig. 3.

On drawing Sheet 4 of 6, replace the informal drawing of Fig. 4 with formal drawing of Fig. 4.

Figure 5:
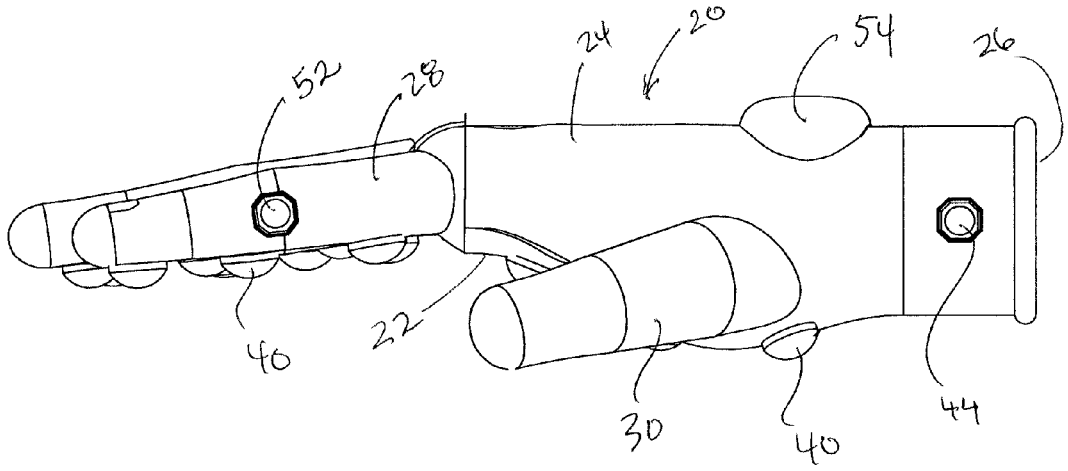
FIG. 5 is a side view of the lighted glove as in FIG. 1.

On drawing Sheet 5 of 6, replace the informal drawing of Fig. 5 with formal drawing of Fig. 5.

Figure 6:
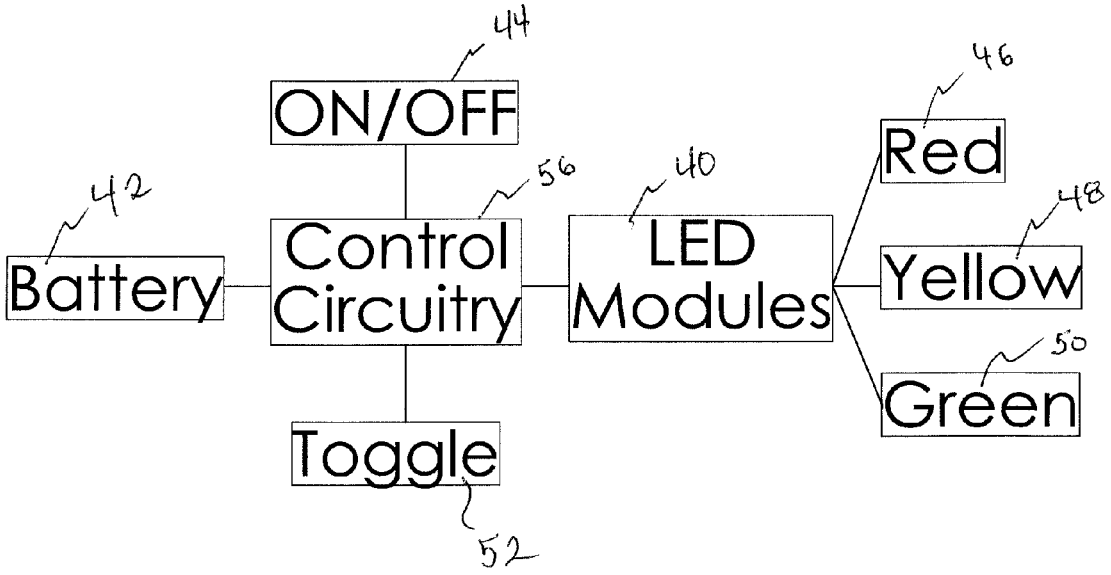
FIG. 6 is a block diagram illustrating the electronic components of the lighted glove as in FIG. 1.
Figure 1:
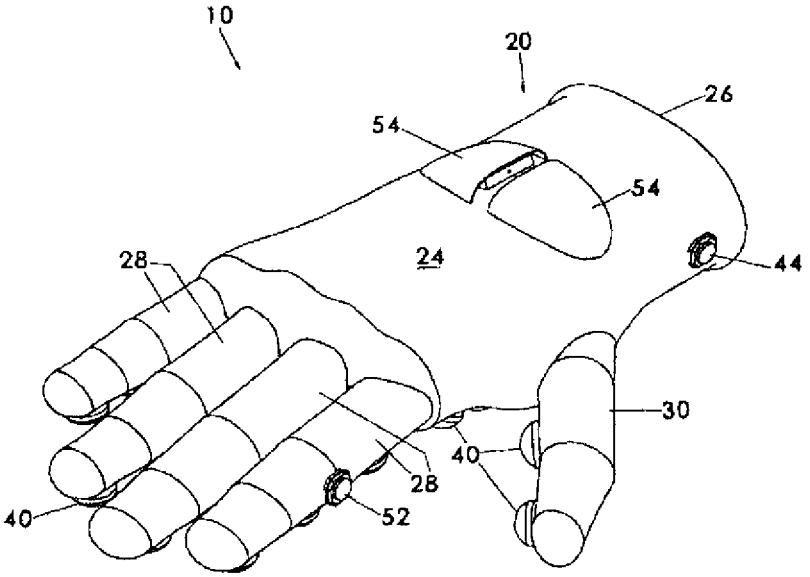
Figure 2:
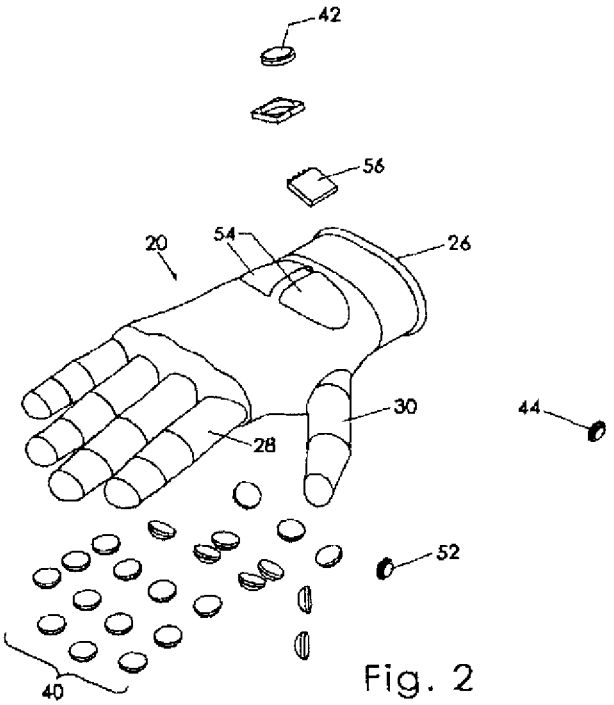
Figure 3:
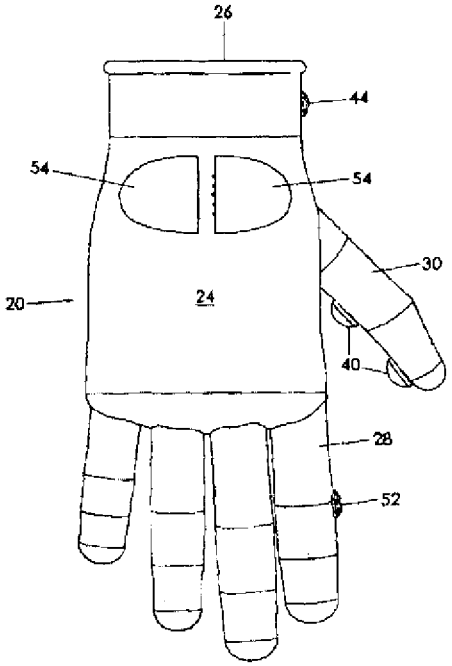
Figure 4:
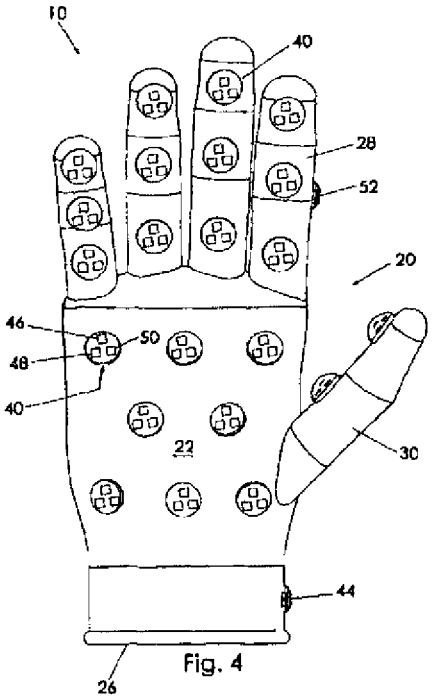
Figure 5:
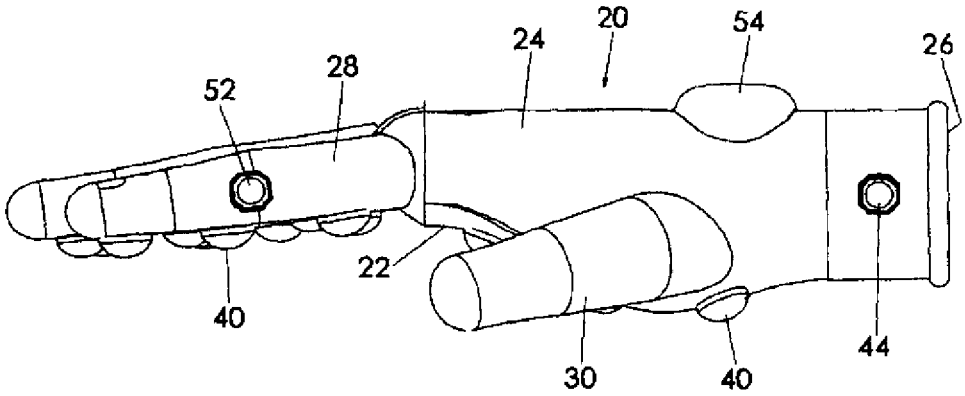
Figure 6:
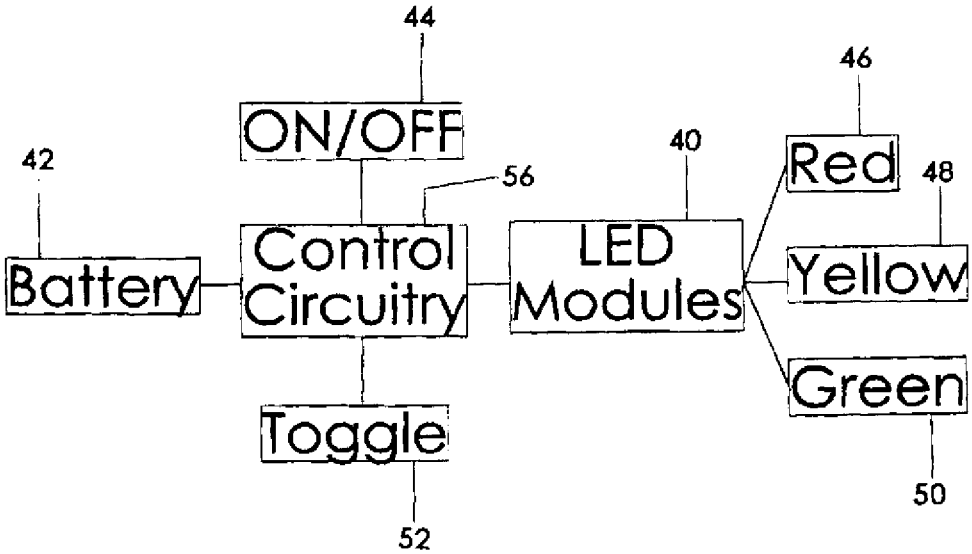

On drawing Sheet 6 of 6, replace the informal drawing of Fig. 6 with formal drawing of Fig. 6.